US010965069B1

(12) United States Patent
Dively et al.

(10) Patent No.: US 10,965,069 B1
(45) Date of Patent: Mar. 30, 2021

(54) RECEPTACLE BREAKAWAY SYSTEM FOR POWER PEDESTALS

(71) Applicant: Marina Electrical Equipment, Inc., Williamsburg, VA (US)

(72) Inventors: Robert C. Dively, Williamsburg, VA (US); Alston G. Brooks, Grafton, VA (US)

(73) Assignee: MARINA ELECTRICAL EQUIPMENT, INC., Williamsburg, VA (US)

( * ) Notice: Subject to any disclaimer, the term of this patent is extended or adjusted under 35 U.S.C. 154(b) by 0 days.

(21) Appl. No.: 17/126,064

(22) Filed: Dec. 18, 2020

(51) Int. Cl.
*H01R 13/73* (2006.01)
*H01R 13/633* (2006.01)

(52) U.S. Cl.
CPC ..... *H01R 13/73* (2013.01); *H01R 13/633* (2013.01); *H01R 2201/26* (2013.01)

(58) Field of Classification Search
CPC .... H01R 13/501; H01R 13/633; H01R 13/73; H01R 13/74; H01R 13/745; H01R 13/748; H01R 2201/26
See application file for complete search history.

(56) References Cited

U.S. PATENT DOCUMENTS

| | | | | |
|---|---|---|---|---|
| 3,885,847 A * | 5/1975 | Thibeault | H01R 13/648 | 439/97 |
| 4,392,012 A * | 7/1983 | Nattel | H02G 3/18 | 174/51 |
| 6,206,718 B1 * | 3/2001 | Takahashi | H01R 4/308 | 439/382 |
| 2003/0079898 A1 * | 5/2003 | Kidman | H02G 3/14 | 174/66 |
| 2016/0064876 A1 * | 3/2016 | Garcia | H01R 13/74 | 439/540.1 |

* cited by examiner

*Primary Examiner* — Oscar C Jimenez
(74) *Attorney, Agent, or Firm* — Peter J. Van Bergen

(57) ABSTRACT

A receptacle breakaway system for power pedestals includes an electric power receptacle having a body and mounting ears with an axis passing through the body and mounting ears. A mounting plate having a hole passing there through is configured for passage of the receptacle's body wherein the mounting ears engage a face of the mounting plate. A first retainer is rigidly coupled to the mounting plate at a first position offset from the receptacle's axis. The first retainer extends at least partially over a first of the mounting ears. A second retainer is rigidly coupled to the mounting plate at a second position offset from the receptacle's axis. The second retainer extends at least partially over a second of the mounting ears. The receptacle's axis passes between the first position and second position.

17 Claims, 4 Drawing Sheets

RECEPTACLE BREAKAWAY SYSTEM FOR POWER PEDESTALS

FIELD OF THE INVENTION

The invention relates generally to power pedestals used in marinas and recreational vehicle parks, and more particularly to an electric-power-receptacle breakaway system for use in power pedestals.

BACKGROUND OF THE INVENTION

Power pedestals are commonly found on boat docks, at recreational vehicle ("RV") parks, and at campgrounds. A power pedestal serves as a local source of electric power for a boat, RV, campsite, etc. A power pedestal includes a housing fixed to a dock, ground, etc., and has one or more electric power receptacles mounted therein that a user plugs into for electricity. The electric power receptacles are typically three or four-prong twist-lock receptacles as is well known in the art.

While twist-lock receptacles provide a secure and robust coupling with the "male" prongs of a power cord, they also subject a power pedestal to substantial damage in certain situations. More specifically, if a boat/vehicle user forgets to disconnect a power cord from a power pedestal's receptacle when driving away from the power pedestal, a substantial pulling force applied to the power cord is transferred to the receptacle and the power pedestal since the power cord's plug is essentially locked into the receptacle. When this occurs, the power pedestal's housing is substantially damaged and/or pulled from its mounting. This generally requires replacement of the power pedestal and can expose live electrical wires.

SUMMARY OF THE INVENTION

Accordingly, it is an object of the present invention to provide a receptacle system for power pedestals that minimizes damage in the event a power cord remains connected thereto while tension is applied to the power cord.

Other objects and advantages of the present invention will become more obvious hereinafter in the specification and drawings.

In accordance with the present invention, a receptacle breakaway system for power pedestals includes an electric power receptacle having a body and mounting ears coupled to opposing sides of its body. The power receptacle has an axis passing through its body and mounting ears. A mounting plate having a hole passing there through is configured for passage of the receptacle's body wherein the mounting ears engage a face of the mounting plate. A first retainer is rigidly coupled to the mounting plate at a first position offset from the receptacle's axis. The first retainer extends at least partially over a first of the mounting ears for applying pressure thereto. A second retainer is rigidly coupled to the mounting plate at a second position offset from the receptacle's axis. The second retainer extends at least partially over a second of the mounting ears for applying pressure thereto. The receptacle's axis passes between the first position and second position.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
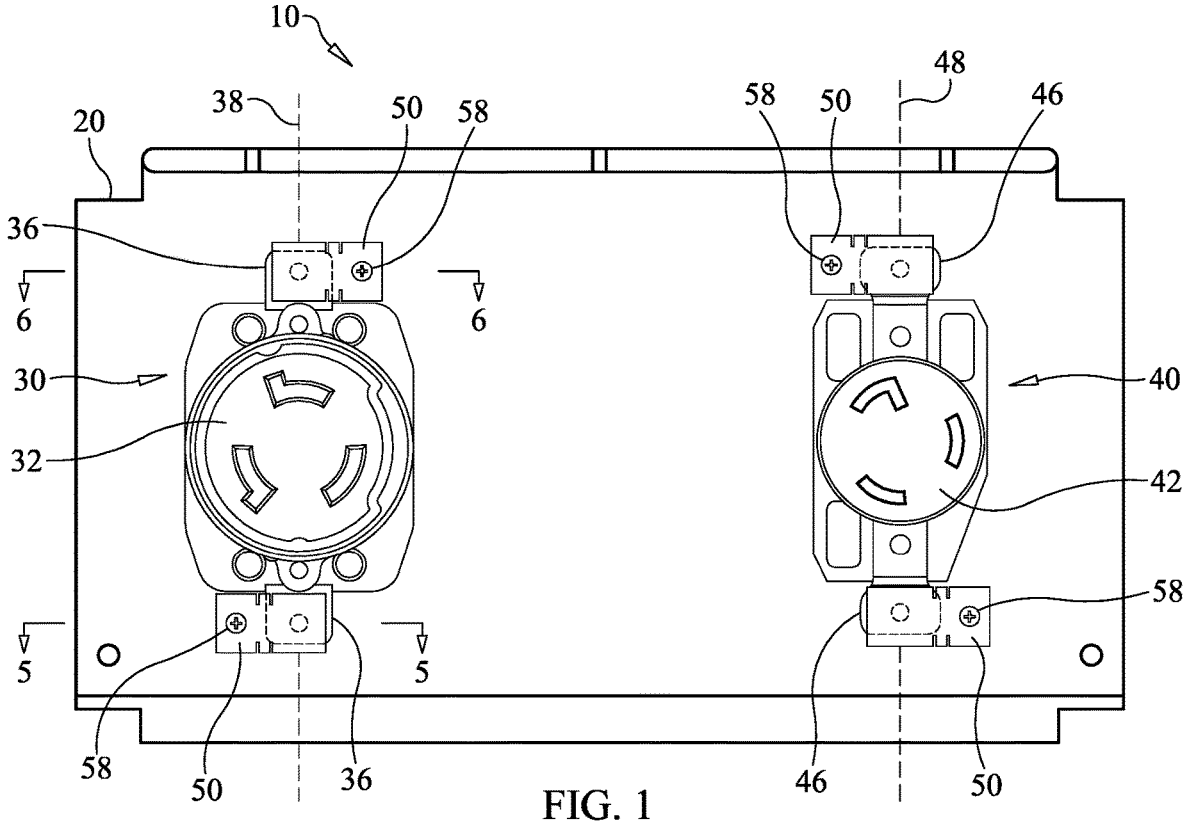
FIG. 1 is a plan view of a receptacle breakaway system for a power pedestal in accordance with an embodiment of the present invention.

Referring now to the drawings and more particularly to FIG. 1, a receptacle breakaway system for a power pedestal in accordance with an embodiment of the present invention is shown and is referenced generally by numeral 10. Breakaway system 10 is subassembly of a power pedestal (not shown). Such power pedestals are known in the art and can be constructed in a variety of ways without changing the scope of the present invention. As is also known is the art, power pedestals are rigidly attached to docks at marinas or ground-based supports at RV parks and campsites.

In the illustrated embodiment, breakaway system 10 includes two electric-power receptacles (e.g., one 50 amp receptacle and one 30 amp receptacle). However, it is to be understood that breakaway systems in accordance with the present invention can have only one receptacle or more than two receptacles without departing from the scope thereof.

Breakaway system 10 includes a mounting plate 20, electric power receptacles 30 and 40, and a plurality of retainers 50. More specifically, two of retainers 50 cooperate with receptacle 30 (e.g., a 50 amp receptacle), and two of retainers 50 cooperate with receptacle 40 (e.g., a 30 amp receptacle). Briefly, two retainers 50 fix a receptacle to mounting plate 20 to satisfy normal operation criteria. In addition, retainers 50 are configured to yield their retention function in the event of a power cord (not shown) remains coupled to one of receptacles 30 or 40 as an abnormal pulling forces unintentionally or inadvertently is applied to the power cord.

Figure 2:
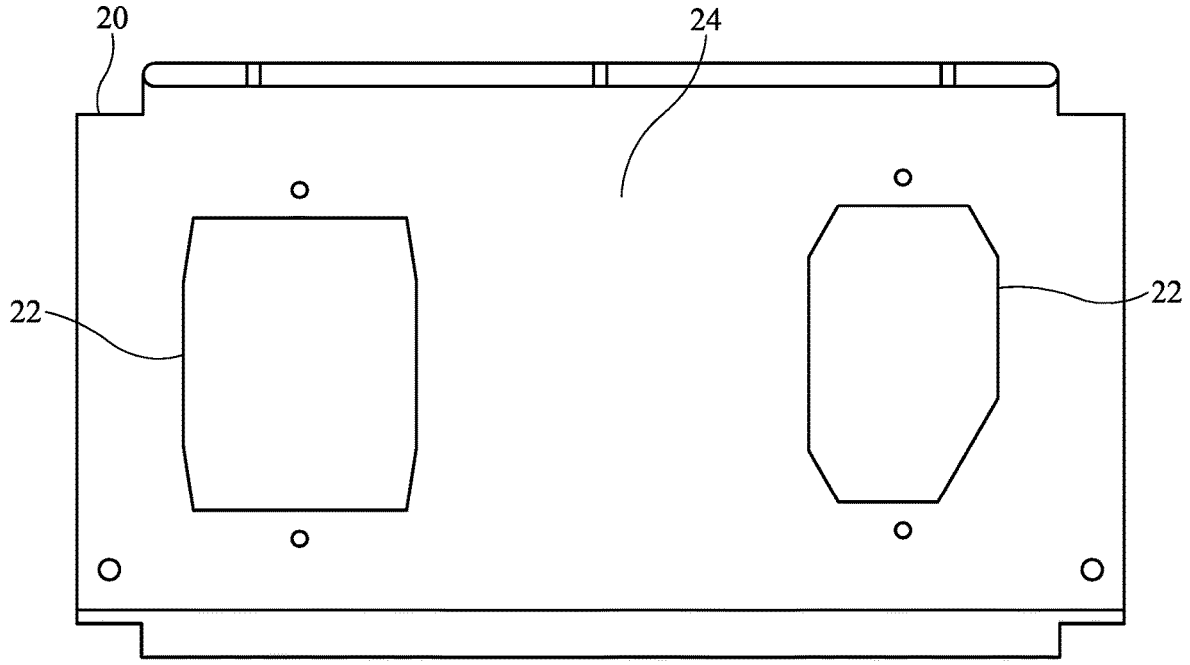
FIG. 2 is an isolated plan view of the breakaway system's mounting plate in accordance with an embodiment of the present invention.

Mounting plate 20, shown in isolation in FIG. 2, can be configured in a variety of ways for cooperation with a power pedestal it is to be mounted in or on. Thus, the outer shape/size and pedestal-mounting features provided by mounting plate 20 can be different than the illustrated embodiment without departing from the scope of the present invention. In general, mounting plate 20 includes a hole 22 (or holes 22 when more than one power receptacle is to be mounted thereto) that allows the body of a power receptacle to pass there through. Each of holes is sized/shaped to cooperate with the supporting body of a power receptacle that will be used therewith.

Figure 3A:
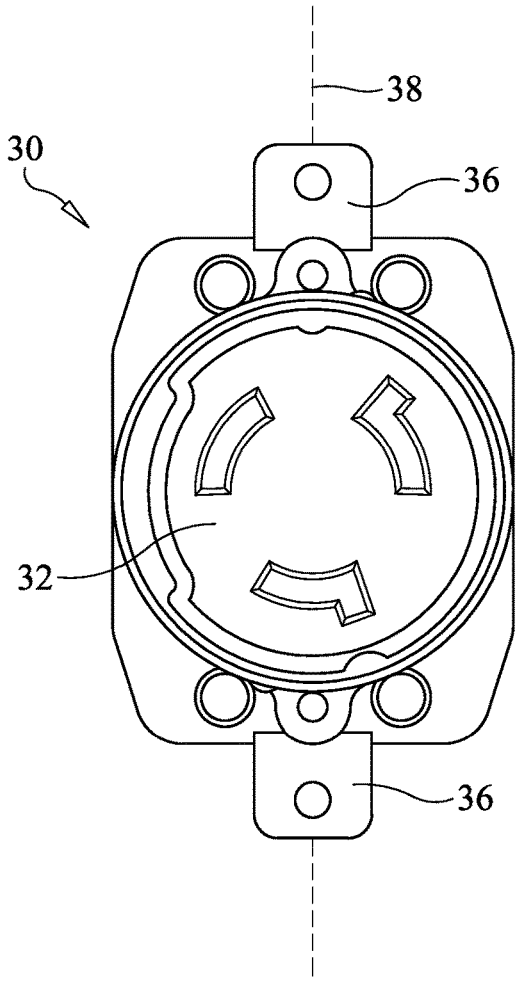
FIG. 3A is an isolated front view of an exemplary twist-lock electric power receptacle.
Figure 3B:
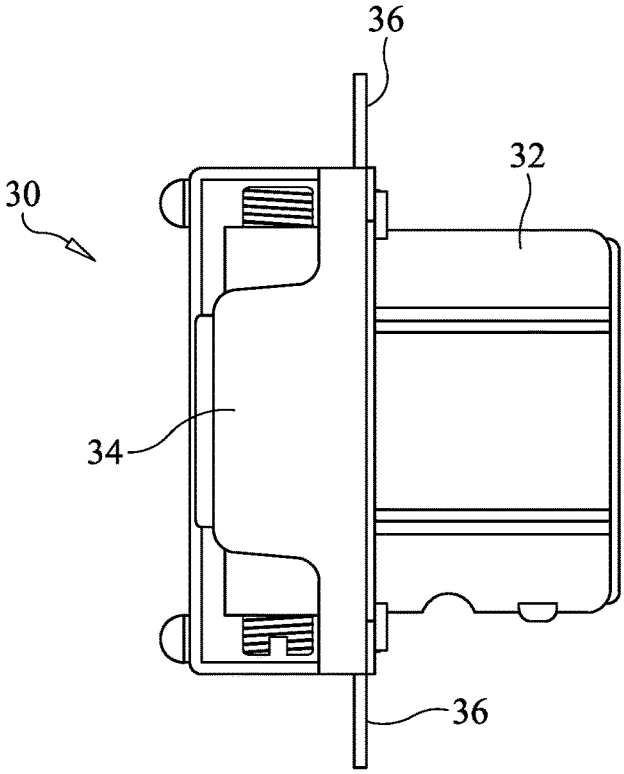
FIG. 3B is an isolated side view of the exemplary twist-lock electric power receptacle.

As is known in the art, each of receptacles 30 and 40 includes a female power-cord receiving housing and a supporting body that passes through one of holes 22 in mounting plate 20. By way of an illustrative example, receptacle 30 is illustrated in isolation in FIGS. 3A and 3B. It is to be understood that receptacle 40 is similarly configured. Receptacle 30 has a power-cord receiving housing 32 and a supporting body 34 (visible only in FIG. 3B) that will pass through a hole 22 in mounting plate 20 such that the receptacle's mounting ears 36 rest against the front face 24 of mounting plate 20. A central axis 38 of receptacle 30 passes through the receptacle's body and mounting ears. Receptacle 40 includes corresponding features illustrated in FIG. 1, to wit, power-cord receiving housing 42, mounting ears 46, and axis 48.

In conventional power pedestals, mounting ears 36 and 46 are rigidly coupled to mounting plate 20 using, for example, screws. However, this leads to the drawbacks discussed previously herein. In accordance with the present invention, receptacles 30 and 40 are not screwed to mounting plate 20 as retainers 50 are used to fix a receptacle to mounting plate 20 to satisfy all normal operating conditions. However, retainers 50 yield if an abnormal pulling force is applied to a receptacle thereby allowing the receptacle to be readily pulled from mounting plate 20 as described above. In this way, only the pulled receptacle needs to be replaced, while a power pedestal's structure and internal features remain intact.

Figure 4:
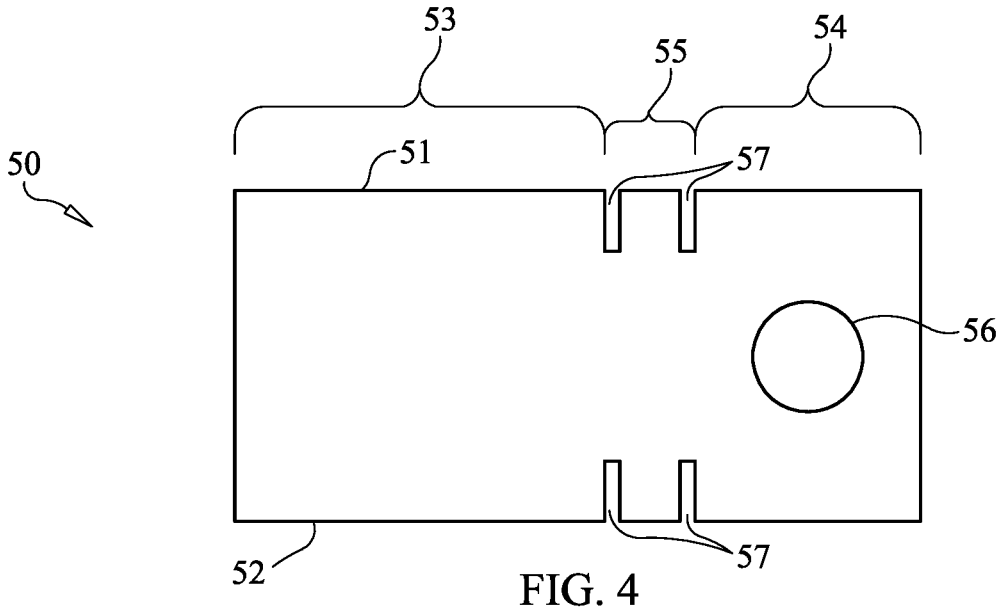
FIG. 4 is an isolated plan view of one of the breakaway system's retainers in accordance with an embodiment of the present invention.
Figure 5:
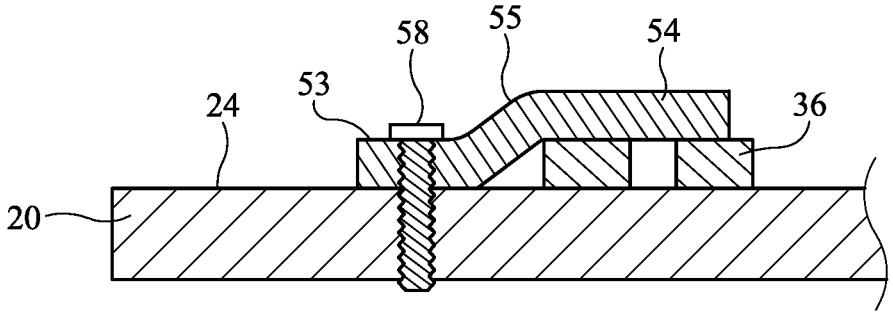
FIG. 5 is a cross-sectional view of a portion of the receptacle breakaway system taken along line 5-5 in FIG. 1.
Figure 6:
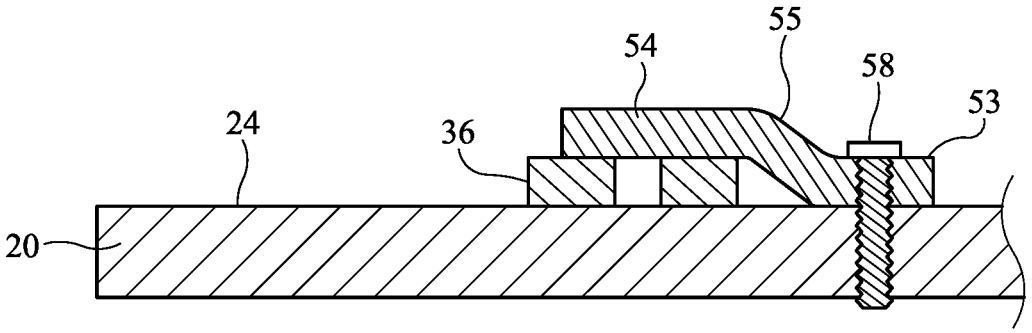
FIG. 6 is a cross-sectional view of another portion of the receptacle breakaway system taken along line 6-6 in FIG. 1.

Referring additional and simultaneously to FIGS. 4-6, an exemplary retainer 50 is shown in isolation in FIG. 4 and in use in FIGS. 5-6. In each of FIGS. 4-6, the views have been enlarged for purposes of description. Retainer 50 is an elongate structure (e.g., rectangular) having two opposing long sides 51 and 52. In the illustrated embodiment, retainer 50 is configured to bend in a controlled fashion in situations where the retainer must yield. Retainer 50 can be made from a strip of metal such as stainless steel so that it resists corrosion in outside environments where power pedestals are typically found.

Retainer 50 includes a retention region 53, a plate attachment region 54 having a screw hole 56, and a weakened region 55 disposed between and coupled to retention region 53 and attachment region 54. Retention region 53 extends partially or fully over one of a receptacle's mounting ears as the retainer's attachment region 54 is rigidly coupled to mounting plate 20 using, for example, a screw 58. That is, each mounting ear of a receptacle is sandwiched between mounting plate 20 and a corresponding one of retainers 50. When screw 58 is tightened, retention region 53 applies pressure to a mounting ear to fix it against mounting plate 20. To hold a receptacle in place for its normal twist-lock operating conditions, a receptacle's two retainers 50 are rigidly coupled to mounting plate 20 at positions offset from the receptacle's central axis (e.g., axis 38 or 48) such that the axis passes between the two plate-coupling positions as illustrated in FIG. 1.

Weekend region 55 controls the bending of retainer 50 for both its normal-condition retention (illustrated in FIGS. 5 and 6), and when the retainer needs to yield as it bends away from plate 20 and the retained receptacle mounting ear. When retainers 50 yield in this way, the retained receptacle is pulled from mounting plate 20 without any damage to plate 20 or the power pedestal in which plate 20 is housed. Weakened region 55 can be configured in a variety of ways without departing from the scope of the present invention. For example, one or more notches can be provided in each of long sides 51/52 of retainer 50. In the illustrated embodiment, weakened region 55 includes thin notches or slits 57 provided in retainer 50 at each of its long sides 51 and 52. To facilitate controlled bending of retainer 50 in its normal installation and operating position shown in FIGS. 5 and 6, a pair of spaced-apart slits 57 is partially cut into each of long sides 51 and 52. Slits 57 at opposing sides 51 and 52 are in direct opposition to one another as illustrated.

The exact size, shape, features, and positions of the features of retainer 50 can be adjusted for a particular application without departing from the scope of the present invention. By way of a non-limiting illustrative example, retainer 50 can be approximately 1 inch long an approximately 0.5 inches wide, can be made from 16 gauge stainless steel, and can have approximately 0.1 inch long slits 57 that are spaced by approximately 0.1 inch along the retainer's long sides.

The advantages of the present invention are numerous. A power pedestal's receptacle is retained in position to support normal use, but readily breaks away from its mounting plate when an abnormal pulling force is applied to the receptacle via its attached power cord. In tests of the present invention, the retainers simply bent away from the mounting plate and receptacle mounting ears when a power cord (attached to the receptacle) had an abnormal pulling force applied thereto. When this occurred, only the receptacle was pulled from the power pedestal thereby keeping damage/repairs to a minimum.

Figure 7A:
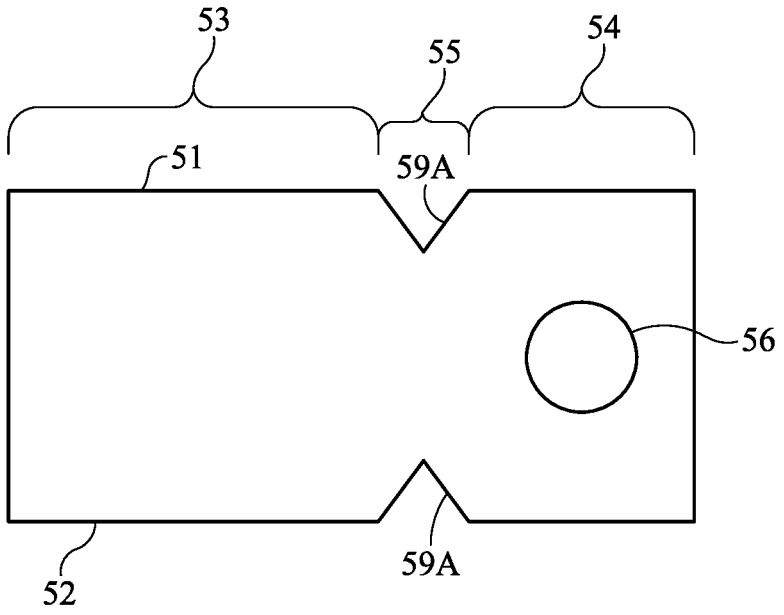
FIG. 7A is an isolated plan view of one of the breakaway system's retainers in accordance with another embodiment of the present invention.
Figure 7B:
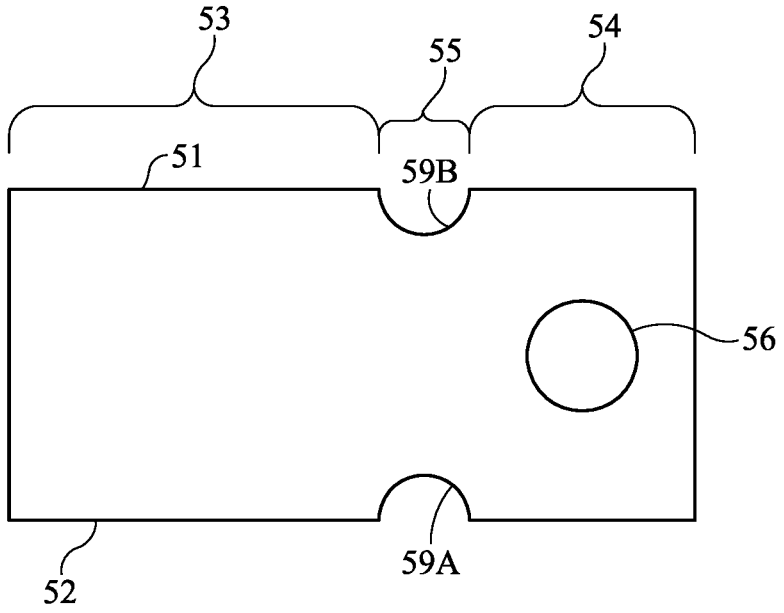
FIG. 7B is an isolated plan view of one of the breakaway system's retainers in accordance with still another embodiment of the present invention.

Although the invention has been described relative to a specific embodiment thereof, there are numerous variations and modifications that will be readily apparent to those skilled in the art in light of the above teachings. For example and as illustrated in FIGS. 7A and 7B, a retainer of the present invention can have a single V-shaped notch 59A (FIG. 7A) or a single U-shaped notch 59B (FIG. 7B) at each opposing long side 51 and 52 of the retainer at its weakened region 55. In still other embodiments of the present invention where controlled bending of the retainer is not critical, the retainer's material and/or thickness could be used to support bending of the retainer when a pulling force is applied to the power receptacle. In such a case, the retainer would still bend out of the way to permit the power receptacle to be pulled from the mounting plate, but the retainer would bend in a way that is not as predictable as is the case when notches/slits are provided as described above. It is therefore to be understood that, within the scope of the appended claims, the invention may be practiced other than as specifically described.

What is claimed as new and desired to be secured by Letters Patent of the United States is:

1. A receptacle breakaway system for power pedestals, comprising:

an electric power receptacle including a body and mounting ears coupled to opposing sides of said body, said power receptacle having an axis passing through said body and said mounting ears;

a mounting plate having a hole passing there through configured for passage of said body wherein said mounting ears engage a face of said mounting plate;

a first retainer rigidly coupled to said mounting plate at a first position offset from said axis, said first retainer extending at least partially over a first of said mounting ears for applying pressure thereto; and a second retainer rigidly coupled to said mounting plate at a second position offset from said axis, said second retainer extending at least partially over a second of said mounting ears for applying pressure thereto, wherein said axis passes between said first position and said second position, and wherein each of said first retainer and said second retainer comprises an elongate structure having a weakened region along the length thereof for controlling bending of said elongate structure in the presence of a bending force applied to said elongate structure.

2. The receptacle breakaway system as in claim 1, wherein said first retainer and said second retainer are identical.

3. The receptacle breakaway system as in claim 1, wherein said weakened region comprises at least one notch in said elongate structure at each of opposing sides thereof.

4. The receptacle breakaway system as in claim 1, wherein said weakened region comprises:

a first pair of spaced-apart slits cut into and along a first long side of said elongate structure; and a second pair of spaced-apart slits cut into and along a second long side of said elongate structure, wherein said first pair of spaced-apart slits and said second pair of spaced-apart slits are in direct opposition to one another.

5. The receptacle breakaway system as in claim 1, wherein each of said first retainer and said second retainer comprises a strip of metal.

6. The receptacle breakaway system as in claim 1, wherein said power receptacle comprises a twist lock receptacle.

7. A receptacle breakaway system for power pedestals, comprising:

an electric power receptacle including a body and mounting ears coupled to opposing sides of said body, said power receptacle having an axis passing through said body and said mounting ears;

a mounting plate having a hole passing there through configured for passage of said body wherein said mounting ears engage a face of said mounting plate;

a first strip of metal rigidly coupled to said mounting plate at a first position offset from said axis, said first strip of metal shaped to extend at least partially over a first of said mounting ears wherein said first of said mounting ears is sandwiched between said first strip of metal and said mounting plate; and a second strip of metal rigidly coupled to said mounting plate at a second position offset from said axis, said second strip of metal shaped to extend at least partially over a second of said mounting ears wherein said second of said mounting ears is sandwiched between said second strip of metal and said mounting plate, and wherein said axis passes between said first position and said second position.

8. The receptacle breakaway system as in claim 7, wherein said first strip of metal and said second strip of metal are identically configured.

9. The receptacle breakaway system as in claim 7, wherein each of said first strip of metal and said second strip of metal includes a weakened region along the length thereof for controlling shaping thereof.

10. The receptacle breakaway system as in claim 9, wherein each said weakened region comprises at least one notch in opposing sides of each of said first strip of metal and said second strip of metal.

11. The receptacle breakaway system as in claim 9, wherein each said weakened region comprises:

a first pair of spaced-apart slits cut partially into and along a first long side of each of said first strip of metal and said second strip of metal; and a second pair of spaced-apart slits cut partially into and along a second long side of each of said first strip of metal and said second strip of metal, wherein said first pair of spaced-apart slits and said second pair of spaced-apart slits are in direct opposition to one another for each of said first strip of metal and said second strip of metal.

12. The receptacle breakaway system as in claim 7, wherein said power receptacle comprises a twist lock receptacle.

13. A receptacle breakaway system for power pedestals, comprising:

an electric power receptacle including a body and mounting ears coupled to opposing sides of said body, said power receptacle having an axis passing through said body and said mounting ears;

a mounting plate having a hole passing there through configured for passage of said body wherein said mounting ears engage a face of said mounting plate;

two identical retainers rigidly coupled to said mounting plate, said two identical retainers including a first retainer and a second retainer, said first retainer being rigidly coupled to said mounting plate at a first position offset from said axis, said first retainer extending at least partially over a first of said mounting ears for pressing said first of said mounting ears against said mounting plate, and said second retainer being rigidly coupled to said mounting plate at a second position offset from said axis, said second retainer extending at least partially over a second of said mounting ears for pressing said second of said mounting ears against said mounting plate, wherein said axis passes between said first position and said second position; and each of said first retainer and said second retainer being an elongate structure having a weakened region along the length thereof for controlling bending of said elongate structure in the presence of a bending force applied to said elongate structure.

14. The receptacle breakaway system as in claim 13, wherein said weakened region comprises at least one notch in said elongate structure at each of opposing sides thereof.

15. The receptacle breakaway system as in claim 13, wherein said weakened region comprises:

a first pair of spaced-apart slits cut into and along a first long side of said elongate structure; and a second pair of spaced-apart slits cut into and along a second long side of said elongate structure, wherein said first pair of spaced-apart slits and said second pair of spaced-apart slits are in direct opposition to one another.

16. The receptacle breakaway system as in claim 13, wherein each of said first retainer and said second retainer comprises a strip of metal.

17. The receptacle breakaway system as in claim 13, wherein said power receptacle comprises a twist lock receptacle.

* * * * *